US006248193B1

(12) United States Patent
Zhao et al.

(10) Patent No.: US 6,248,193 B1
(45) Date of Patent: Jun. 19, 2001

(54) PROCESS FOR PRODUCING AN ALUMINUM ALLOY SHEET

(75) Inventors: Pizhi Zhao, Fuji; Takeshi Moriyama, Nagoya; Noboru Hayashi, Kawachi-gun; Kunihiro Yasunaga, Kanuma, all of (JP); Paul Wycliffe, Kingston; David James Lloyd, Bath, both of (CA)

(73) Assignees: Nippon Light Metal Company, Ltd. (JP); Alcan International Limited (CA); Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/508,172

(22) PCT Filed: Sep. 10, 1998

(86) PCT No.: PCT/JP98/04079

§ 371 Date: May 12, 2000

§ 102(e) Date: May 12, 2000

(87) PCT Pub. No.: WO99/13124

PCT Pub. Date: Mar. 18, 1999

(30) Foreign Application Priority Data

Sep. 11, 1997 (JP) ..... 9-246705

(51) Int. Cl.[7] ..... C22F 1/04; C22F 1/047

(52) U.S. Cl. ..... 148/693; 148/694; 148/697; 148/551

(58) Field of Search ..... 148/691, 692, 148/693, 694, 695, 696, 697, 551

(56) References Cited

U.S. PATENT DOCUMENTS 3,617,395 * 11/1971 Ford ..... 14/696

FOREIGN PATENT DOCUMENTS

| | | | | |
|---|---|---|---|---|
| 0 259 700 | | 3/1988 | (EP) . | |
| 63-255346 | * | 10/1988 | (JP) | 148/695 |
| 4-187748 | | 7/1992 | (JP) . | |
| 4-276049 | * | 10/1992 | (JP) | 148/695 |
| 5-179413 | | 7/1993 | (JP) . | |
| 0 646 655 | | 4/1995 | (JP) . | |

* cited by examiner

*Primary Examiner*—Deborah Yee
(74) *Attorney, Agent, or Firm*—Parkhurst & Wendel, L.L.P.

(57) ABSTRACT

A continuously cast and rolled sheet of an aluminum alloy having Mg in a content of 3 to 6% by weight is annealed, followed by strain correction, heat and hold treatment at a given temperature between 240° C. and 340° C. for one hour or more, and slowly cooling treatment, to thereby provide an aluminum alloy sheet having enhanced resistance to stress corrosion cracking and improved shape fixability. The slowly cooling treatment is carried out at a cooling rate chosen from a preset cooling zone corresponding to a present temperature zone S defined in obliquely lined surround form in the accompanying drawing.

1 Claim, 1 Drawing Sheet

PROCESS FOR PRODUCING AN ALUMINUM ALLOY SHEET

TECHNICAL FIELD

This invention concerns a process for the production of an Al—Mg alloy sheet, which affords enhanced resistance to stress corrosion cracking and improved shape fixability after press.

BACKGROUND ART

Aluminum alloy sheets are light in weight as compared to a steel sheet and have good formability, and therefore, they have today taken the place of the steel sheet in sectors of body sheets for automotive vehicles, skeletal structures, ship components and the like. For its great strength and excellent formability, an alloy of an Al—Mg type (JIS Type 5000 series) has been proposed as typically applicable to the aluminum alloy sheets noted above.

The Al—Mg alloy, however, has the problem that upon lapse of a prolonged period of time after deforming, it tends to cause β phase ($Al_2Mg_3$) to preferentially precipitate as a form of film in its grain boundary, thus bringing about stress corrosion cracking. Various techniques have been found in solving this problem. For instance, Japanese Unexamined Patent Publication No. 4-187748 discloses a method of the production of an aluminum alloy sheet for automotive use having high resistance to stress corrosion cracking. The method comprises homogenizing an aluminum alloy ingot having Mg in a content of 3.5 to 5.5% by weight, hot-rolling and then cold-rolling the ingot, annealing the resultant sheet, without further cold rolling, and subjecting the annealed sheet to hold for 0.5 to 24 hours at a temperature of 150 to 230° C. As a like instance, JP5-179413A or JP63-255346A discloses a method in which process comprises homogenizing aluminum alloy ingot after casting, hot-rolling and then cold-rolling the ingot, and annealing and slowly cooling the resultant sheet.

In order to improve the shape retention after deforming of an Al—Mg type alloy sheet, namely the shape fixability thereof, it is desired that the proof stress (or 0.2% yield strength) of such sheet be rendered to be as low as possible. To this end, a certain method is known as taught in Japanese Examined Patent Publication No. 6-68146. This prior art method contemplates cold-rolling a hot-rolled sheet or a continuously cast slab of an Al—Mg type alloy containing Mg in an amount of 2 to 6% by weight, and recrystallizing, quenching and solution heat treatment the cold-rolled sheet by means of quick heating and quick cooling, followed by annealing and correction treatment of the resultant sheet. In such method, when the heating temperature after correction is preset to range from 60 to 200° C., heating and cooling is carried out at a rate of $4\times10^{-3}$° C./sec or above. In the case of the heating temperature at from 200 to 360° C., heating and cooling are effected at a rate of $1.225\times10^{-3}$ T−0.241° C./sec or more where T denotes the heating temperature, this definition applying as such to the following instances. Alternatively, heat treatment is conducted for $10^5$ seconds or less in the case of the heating temperature at from 60 to 160° C., for $-5.33\times10^5$ T$+9.5\times10^5$ seconds or less in the case of the heating temperature at from 160 to 175° C., for $-1.65\times10$ T$+4.89\times10^4$ seconds or less in the of the heating temperature at from 175 to 290° C., and for $-7.14$ T$+3.07\times10^3$ seconds or less in the case of the heating temperature at from 290 to 360° C. In that way, an aluminum alloy sheet is producible which is suitable for automotive use and has high strength and good formability.

However, the Al—Mg type alloy sheet obtained from continuous casting and rolling with use of the above cited method has the drawback that when heat-treated, it fails to attain sufficient resistance to stress corrosion cracking and adequate reduction in proof stress.

DISCLOSURE OF INVENTION

With the aforementioned defects of the prior art in view, the present invention provides a process for the production of an aluminum alloy sheet that is fabricated from continuous casting and rolling and is excellent in respect of stress corrosion cracking resistance under stress and shape fixability.

Through research made to solve those prior problems and leading to the present invention, it has now been found by the present inventors that as sharply contrasted to a conventional production method of an Al—Mg type alloy sheet, an Al—Mg type alloy sheet fabricated from continuous casting and rolling can be stabilized at a by far higher temperature which is then allowed to drop at a by far slower cooling rate so as to effect cooling so that resistance to stress corrosion cracking may be enhanced, proof stress be reduced, and shape fixability after press be improved. Namely, the Al—Mg type alloy sheet continuously cast and rolled does not undergo homogenization treatment and hence causes Mg to be segregated to a marked extent. This means that sensibility to stress corrosion cracking is conversely objectionably increased by treatment at those heating temperatures and cooling rates commonly known in the art. To be more specific, Mg would presumably get continuously precipitated, as β phase along the associated grain boundary, at a markedly segregated region at which stress corrosion cracking might take place. This problem can be obviated by application of the process concept found above by the present inventors; that is, β phase is caused to discontinuously precipitated in an Al—Mg alloy sheet having a small content of Mg and fabricated from continuous casting and rolling. Such specific process leads to high resistance to stress corrosion cracking, small proof stress and good shape fixability after press.

According to the present invention, there is provided a process for the production of an aluminum alloy sheet having enhanced resistance to stress corrosion cracking and improved shape fixability. The process comprises: annealing a continuously cast and rolled sheet of an aluminum alloy having Mg in a content of 3 to 6% by weight; strain-correcting the annealed sheet; heating the corrected sheet at a temperature chosen from a preset temperature zone, the preset temperature zone being defined in such a manner that a rectangular ordinate system is drawn with an abscissa axis of heat treatment temperature (° C.) and an ordinate axis of cooling rate (° C./sec), a heating temperature region being surrounded by connecting a straight line between coordinate (240, $5.0\times10^{-3}$) and coordinate (340, $2.5\times10^{-3}$), a straight line between coordinate (240, $1.0\times10^{-3}$) and coordinate (340, $1.0\times10^{-3}$), a straight line between coordinate (240, $5.0\times10^{-3}$) and coordinate (240, $1.0\times10^{-3}$) and a straight line between coordinate (340, $2.5\times10^{-3}$) and coordinate (340, $1.0\times10^{-3}$), respectively; subjecting the resultant sheet to hold for one hour or more; and subsequently cooling the same at a cooling rate corresponding to the preset temperature zone.

BEST MODE FOR CARRYING OUT THE INVENTION

Figure 1:
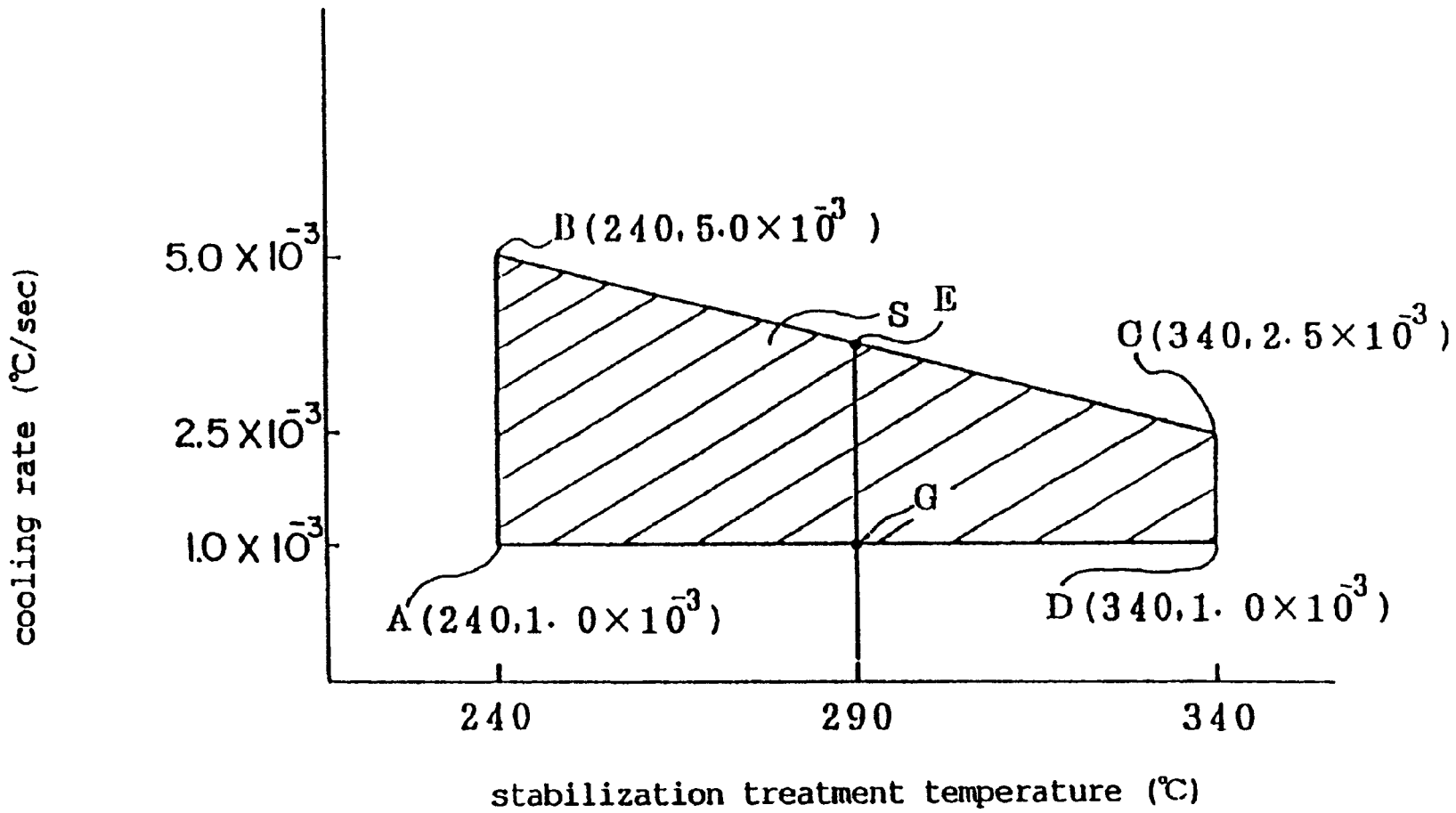
FIG. 1 is a graphic representation of a limited zone useful for final heat treatment between the stabilization temperature and the cooling rate.

An aluminum alloy eligible for the present invention is an Al—Mg type alloy containing 3 to 6% by weight. A content of Mg of at least 3% by weight is conducive to high strength and sufficient press formability. Below 3% by weight in the content of Mg is less effective in attaining these results. Inversely, above 6% by weight involves too high strength for deforming of the sheet such as rolling, bending and the like, and further makes the sheet sensitive to stress corrosion cracking with eventual difficulty in maintaining the stable quality of the finished sheet for an extended period of time and also with ultimate decline in shape fixability. In consequence, the content of Mg should be from 3 to 6% by weight, preferably 5.5% or less by weight, ore preferably 5% or less by weight.

The continuously cast and rolled sheet stated above is repared by continuously casting molten aluminum alloy having g in a content of 3 to 6% by weight to a slab, and by immediately rolling the resultant slab into a given sheet thickness. This continuously cast and rolled sheet is annealed for softening and, then, strain-corrected. To gain sufficient improvements in stress corrosion cracking resistance and in shape fixability as concerns the sheet obtained at that stage, heat and hold treatment and subsequent slowly cooling treatment are thereafter conducted such that Mg segregated in the sheet is adequately precipitated as β phase along the grain boundaries in the form of particles.

The heat and hold treatment mentioned above is achieved by heating at a temperature of 240 to 340° C. and by holding at that temperature for one hour or more. The heat and hold treatment, followed by the slowly cooling treatment, ensures that Mg segregated through continuous casting be reliably precipitated in the form of particles along the grain boundary. The two modes of treatment afford not only low proof stress and least sensitivity to stress corrosion cracking, but also good shape fixability in an economical manner.

The slowly cooling treatment noted above is carried out at a rate chosen from a cooling zone predetermined to correspond to a preset heat and hold temperature zone. The heat and hold temperature zone being defined in such a manner that a rectangular ordinate system is drawn with an abscissa axis of temperature (° C.) and coordinate axis of cooling rate (° C./sec), a heating temperature region being surrounded by connecting a straight line between coordinate (240, $5.0\times10^{-3}$) and coordinate (340, $2.5\times10^{-3}$), a straight line between coordinate (240, $1.0\times10^{-3}$) and coordinate (340, $1.0\times10^{-3}$), a straight line between coordinate (240, $5.0\times10^{-3}$) and coordinate (240, $1.0\times10^{-3}$) and a straight line between coordinate (340, $2.5\times10^{-3}$) and coordinate (340, $1.0\times10^{-3}$), respectively.

In practicing the process according to the present invention, alloy elements other than Mg can be incorporated where desired. In the case where higher strength is needed, one or more selected from Cu, Fe, Mn, Zn, Cr, Zr and V may be added, respectively, in an amount of about 0.1 to 2% by weight. Cracking produced during continuous casting may be avoided by the addition of Ti in an amount of less than 0.1% by weight, or Ti in an amount of 0.1% or less by weight combined with B in an amount of less than 0.05% by weight. When molten alloy is prepared from an aluminum alloy, impure elements contained in an aluminum remelt ingot or a return scrap may be regarded as tolerable so long as they are within the contents generally stipulated by JIS Type 5000 series.

The present invention will now be described in greater detail with reference to one preferred embodiment of the aluminum alloy sheet produced thereby.

In this embodiment, an aluminum alloy sheet can be produced by continuously casting molten aluminum alloy of a selected composition into a slab of 5 to 30 mm in thickness with use of a continuous casting method such as a twin-rolling casting method, a belt-casting method, a 3C method or the like, and by immediately rolling the slab by means of both hot rolling and cold rolling, or by means of cold rolling alone, to thereby prepare a sheet having a predetermined thickness. Annealing may be conducted, when needed, after hot rolling or during cold rolling. Upon subsequent final annealing to effect recrystallization and softening at the recrystallization temperature, correction treatment called leveling is run as by slight rolling or stretching in a loss of sheet thickness of about 0.5 to 2% so that decreased flatness is eliminated which has been produced during cold rolling and annealing treatment.

This annealing treatment intends to recrystallize the cold rolled sheet to improve formability. To this end, a continuous or batch annealing can be used. Continuous annealing may be involved uncoiling and conducted at a temperature of 450 to 530° C. for a holding time of about 1 second to 10 minutes with a heating rate of 5° C./sec or more for effecting softening treatment through recrystallization. This mode of continuous annealing enables shortening of annealing treatment and moreover prevents growth of recrystalline grains and hence coarseness of the grains. Lower than 5° C./sec or longer holding times than 10 minutes cause coarsened recrystallized grain, thus showing worse formability.

Batch annealing may treat the associated coil in an annealing furnace, effecting softening treatment through recrystallization at a temperature of 300 to 400° C. for a holding time of about 10 minutes to 5 hours with a heating rate of about 40° C./sec. Higher heating temperatures than 400° C. or longer holding times than 5 hours involve coarsened recrystallized grain and hence impaired formability, and also thickened oxide film on the surface of the sheet. Lower heating temperatures than 300° C. or shorter holding times than 10 minutes are not effective for recrystallization.

Whichever of both modes of annealing is adopted, the resulting sheet becomes strained during cold rolling and annealing, ultimately suffering from distorted flatness. When used as it is, the sheet invites delivering troubles and worse shape at a pressing stage. Hence, the sheet is subjected in the form of a coil or a sheet to strain-correction treatment as by repeated bending with use a level roll so that the distortion of the sheet is corrected with recovered flatness.

The continuously cast and rolled sheet does not undergo homogenization treatment. For this reason, Mg segregates to a great extent, and because of the change of the property with time after stamping, β phase preferentially precipitated in continuous form along grain boundaries so that the sheet is highly sensitive to stress corrosion cracking as discussed above. Additionally, the correction treatment following the annealing treatment corresponds to a sort of cold rolling, resulting in increased proof stress and hence increased spring back, and also in diminished shape fixability. To improve stress corrosion cracking resistance and shape fixability, the correction-treated sheet should be stabilized by heat and hold treatment and slowly cooling. This treatment and/or slowly cooling are performed to precipitate segregated Mg as β phase in the form of particles.

The accompanying drawing graphically represents a limited or specified zone useful for stabilization treatment between the stabilization temperature (° C.) and the cooling rate (° C./sec). In implementing the stabilization treatment, heat and hold treatment is first done for one hour or more at a given temperature between 240° C. and 340° C. so as to completely eliminate those defects induced from correction treatment mentioned hereinabove, followed by slowly cooling. More specifically, heat and hold treatment is effected for one hour or longer at a temperature in the above range according to the graph of the drawing, and slowly cooling treatment is thereafter conducted at a cooling rate shown as the ordinate axis and corresponding to a preset temperature zone, the temperature zone being defined in such a manner that a rectangular ordinate system is drawn with an abscissa axis of stabilization treatment temperature (° C.) and an ordinate axis of cooling rate (° C./sec), a heating temperature region S (obliquely lined) being surrounded by connecting a straight line between coordinate B (240, $5.0\times10^{-3}$) and coordinate C (340, $2.5\times10^{-3}$), a straight line between coordinate A (240, $1.0\times10^{-3}$) and coordinate D (340, $1.0\times10^{-3}$), a straight line between coordinate B (240, $5.0\times10^{-3}$) and coordinate A (240, $1.0\ 5\times10^{-3}$) and a straight line between coordinate C (340, $2.5\times10^{-3}$) and coordinate D (340, $1.0\times10^{-3}$), respectively. For example, in the case of heat and hold treatment at 290° C. for one hour, the cooling rate for slowly cooling treatment may be set at a numeral value between coordinate E and coordinate G, i.e., in the range of $3.75\times10^{-3}$ to $1.0\times10^{-3}$/sec.

Both the heat and hold treatment and the slowly cooling treatment are required to adequately precipitate Mg, which segregates remarkably due to continuous casting, in scissioned form along a grain boundaries, thereby eliminating sensitivity of the resultant sheet to stress corrosion cracking, and to reduce the proof stress of such sheet, thereby improving shape fixability. Lower heat temperatures than 240° C., and cooling speeds over the upper limit, namely those lying upstream of the B-C line in the drawing, fail to exert the above advantages. Higher temperatures than 340° C. allow an effect of elimination of stress caused by strain correction to become saturated, eventually producing no better results only with cost burdens. Furthermore, cooling rate below the lower limit, namely those lying downstream of the A-D line in the drawing, invite prolonged treatment in an uneconomical manner.

EXAMPLES

The present invention is further illustrated by those examples shown in Table 1 through Table 4.

A molten alloy was prepared as by degassing, filtration and the like in conventional manner. The molten alloy was subjected to continuous casting and rolling, whereby two different types of continuously cast and rolled sheets were obtained, the alloy compositions of which were tabulated in Table 1. Under the fabricating conditions and heat treatment conditions listed in Table 2, the two continuously cast and rolled sheets were formed into product sheets as inventive examples. Those sheet fabricating and heat treatment conditions were divided into four groups, namely groups A, B, C and D. Product sheets as comparative examples were likewise formed from continuously cast and rolled sheets under the fabricating conditions and heat treatment conditions listed in Table 3. These sheet fabrication and heat treatment conditions were divided into six groups, namely groups E, F, G, H, I and J.

As shown in Table 2 and Table 3, slabs of given thickness prepared from continues casting were directly rolled, without scalping nor soaking, into 1.0 mm-thick sheets. Some of the slabs were intermediately annealed (recrystallized) during cold rolling, and some were directly subjected to cold rolling without intermediate annealing. Subsequently, the 1.0 mm-thick cold-rolled sheet was rapidly heated from room temperature to 500° C. with a heating rate of 200° C./sec, and held for 2 seconds at the temperature and by subsequent quenching of the annealed sheet at a cooling rate of 40° C./sec. Distortion of flatness of the sheet caused by cooling at the preceding stage was corrected with use of a tension leveler, and stabilization treatment was then conducted during one hour under the conditions of a stabilization treatment temperature and a cooling speed defined by the specified zone S (obliquely lined) of the drawing.

Measured mechanical properties and stress corrosion cracking resistance of the stabilization treated sheets were listed in Table 4.

The stress corrosion cracking resistance was determined by the following method.

The 1.0 mm-thick sheet was cold-rolled by further 30% reduction to thereby prepare a 0.7 mm-thick sheet, thereafter sensitized at 120° C. for 168 hours. This sheet was cut to a 20 mm-wide, 83 mm-long size which was taken as a specimen. The resultant specimen was bent along a jig of 4.5 cm in inner radius into a loop, followed by loading of a certain amount of strain on the loop and by subsequent continuous immersion of the same in a salt solution of 3.5% NaCl at 35° C. The time required for cracking to occur was measured and taken as the service life of stress corrosion cracking resistance.

From Table 4, 25 days or longer had passed before cracking took place in the inventive examples (groups A, B, C and D). Short periods of time of 2 hours to 5 days were seen in the comparative examples in which stabilization treatment was omitted (groups E and G), lower temperatures were used for stabilization treatment (groups F, H and J), and a higher cooling speed was employed for stabilization treatment (group I). Accordingly, it has been found that the stabilization treatment according to the present invention is of great importance in enhancing resistance to stress corrosion cracking.

In addition, the inventive examples reveal lower proof stress than the comparative examples, meaning that the former excel in shape fixability.

TABLE 1

Compositions of Alloys

| Alloy | Composition (% by weight) | | | | | | | |
|---|---|---|---|---|---|---|---|---|
| No. | Mg | Fe | Si | Mn | Cr | Cu | Ti | B |
| 1 | 4.55 | 0.23 | 0.07 | 0.24 | 0.01 | 0.04 | <0.01 | <0.01 |
| 2 | 3.45 | 0.20 | 0.05 | 0.02 | 0.01 | 0.01 | <0.01 | <0.01 |

TABLE 2

Sheet Fabrication Conditions and Heat Treatment Conditions

| Example | Group | Alloy No. | Casting method/slab thickness (mm) | Scalping | Soaking | Thickness after hot rolling (mm) | Thickness after interannealing (mm)/ annealing temperature (° C.) | Final thickness (mm) | Final annealing temperature (° C.) | Stabilization treatment Temperature (° C.) | Stabilization treatment Cooling rate (° C./sec) |
|---|---|---|---|---|---|---|---|---|---|---|---|
| Inventive Example | A | 1 | continuous 25 | no | no | 6.0 | — | 1.0 | 500 | 240 | $3.1 \times 10^{-3}$ |
| | B | 1 | continuous 25 | no | no | 6.0 | 1.2/330 | 1.0 | 500 | 240 | $5.0 \times 10^{-3}$ |
| | C | 1 | continuous 25 | no | no | 6.0 | 1.2/330 | 1.0 | 500 | 340 | $2.5 \times 10^{-3}$ |
| | D | 2 | continuous 6 | no | no | | Cold rolling | 1.0 | 500 | 240 | $5.0 \times 10^{-3}$ |

TABLE 3

Sheet Fabrication Conditions and Heat Treatment Conditions

| Example | Group | Alloy No. | Casting method/slab thickness (mm) | Scalping | Soaking | Thickness after hot rolling (mm) | Thickness after interannealing (mm)/ annealing temperature (° C.) | Final thickness (mm) | Final annealing temperature (° C.) | Stabilization treatment Temperature (° C.) | Stabilization treatment Cooling rate (° C./sec) |
|---|---|---|---|---|---|---|---|---|---|---|---|
| Comparative Example | E | 1 | continuous 25 | no | no | 6.0 | — | 1.0 | 500 | — | — |
| | F | 1 | continuous 25 | no | no | 6.0 | — | 1.0 | 500 | 150 | $5.0 \times 10^{-3}$ |
| | G | 1 | continuous 25 | no | no | 6.0 | 1.2/330 | 1.0 | 500 | — | — |
| | H | 1 | continuous 25 | no | no | 6.0 | 1.2/330 | 1.0 | 500 | 150 | $5.0 \times 10^{-3}$ |
| | I | 1 | continuous 25 | no | no | 6.0 | 1.2/330 | 1.0 | 500 | 240 | 0.3 |
| | J | 2 | continuous 6 | no | no | | Cold rolling | 1.0 | 500 | 150 | $5.0 \times 10^{-3}$ |

TABLE 4

Mechanical Properties and Stress Corrosion Cracking Resistance (SCC)

| Example | Group | Alloy No. | Mechanical properties: Proof stress (MPa) | Strength (MPa) | Elongation (%) | SCC life | Evaluation |
|---|---|---|---|---|---|---|---|
| Inventive Example | A | 1 | 133 | 286 | 29 | >100 days | ○ |
| | B | 1 | 121 | 281 | 25 | >25 days | ○ |
| | C | 1 | 115 | 280 | 26 | >25 days | ○ |
| | D | 2 | 88 | 225 | 28 | >25 days | ○ |
| Comparative Example | E | 1 | 154 | 290 | 29 | 2 hr | X |
| | F | 1 | 143 | 286 | 30 | 2 hr | X |
| | G | 1 | 137 | 272 | 24 | 2 hr | X |
| | H | 1 | 128 | 278 | 25 | 2 hr | X |
| | I | 1 | 123 | 280 | 26 | 2 hr | X |
| | J | 2 | 108 | 229 | 27 | 5 days | X |

As described and shown hereinabove, the process for the production of an aluminum alloy sheet according to the present invention can provide a continuously cast and rolled sheet of an Al—Mg type having a small content of Mg which offers enhanced resistance to stress corrosion cracking under stress as well as reduced proof stress and hence improved shape fixability as compared to the prior art method. This sheet is suitably applicable as automotive body sheets, skeletal structures, air cleaners, oil tanks, ship components, metal cages, household appliances and so on.

What is claimed is:

1. A process for the production of an aluminum alloy sheet having enhanced resistance to stress corrosion cracking under stress and improved shape fixability, which process comprises in sequential order: annealing a continuously cast and rolled sheet of an aluminum alloy having Mg in a content of 3 to 5% by weight; strain-correcting the annealed sheet by rolling or stretching in a loss of sheet thickness 0.5 to 2%; heating the strain-corrected sheet at a temperature chosen from a preset temperature zone, the preset temperature zone being defined in such a manner that a rectangular ordinate system is drawn with an abscissa axis of heat treatment temperature (° C.) and an ordinate axis of cooling rate (° C./sec), a heating temperature region being surrounded by connecting a straight line between coordinate (240, $5.0\times10^{-3}$) and coordinate (340, $2.5\times10^{-3}$), a straight line between coordinate (240, $1.0\times10^{-3}$) and coordinate (340, $1.0\times10^{-3}$), a straight line between coordinate (240, $5.0\times10^{-3}$) and coordinate (240, $1.0\times10^{-3}$) and a straight line between coordinate (340, $2.5\times10^{-3}$) and coordinate (340, $1.0\times10^{-3}$), respectively; subjecting the heated sheet to hold at the chosen temperature for one hour or more; and subsequently cooling the resultant sheet at a cooling rate corresponding to the preset temperature zone.

* * * * *